US009506726B2

(12) United States Patent
Wolf

(10) Patent No.: US 9,506,726 B2
(45) Date of Patent: Nov. 29, 2016

(54) ACCESSORY MOUNTING SYSTEM FOR FIREARMS

(71) Applicant: ZEV Technologies, Inc., Oxnard, CA (US)

(72) Inventor: Alec Daniel Wolf, Newbury Park, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 14/565,270

(22) Filed: Dec. 9, 2014

(65) Prior Publication Data

US 2015/0241175 A1 Aug. 27, 2015

Related U.S. Application Data

(60) Provisional application No. 61/913,808, filed on Dec. 9, 2013.

(51) Int. Cl.
*F41G 11/00* (2006.01)
*F41G 1/26* (2006.01)

(52) U.S. Cl.
CPC ..... *F41G 11/005* (2013.01); *F41G 1/26* (2013.01)

(58) Field of Classification Search
CPC ..... F41G 1/16; F41G 1/06; F41G 1/18; F41G 11/001–11/005; F41G 1/30
USPC ..... 42/11–117, 124–127, 135–137, 139, 42/148
See application file for complete search history.

(56) References Cited

U.S. PATENT DOCUMENTS

| | | | | |
|---|---|---|---|---|
| 428,458 | A | 5/1890 | Cochran et al. | |
| 1,257,713 | A | 2/1918 | Johnson | |
| 2,030,312 | A | 2/1936 | Mossberg | |
| 2,079,266 | A | 5/1937 | Vaver | |
| 2,162,090 | A | 6/1939 | King | |
| 2,438,601 | A | 3/1948 | Davis | |
| 2,465,561 | A | 3/1949 | Wilson | |
| 3,193,932 | A | 7/1965 | Johnson | |
| 3,199,202 | A | 8/1965 | Williams | |
| 3,838,522 | A | 10/1974 | Williams | |
| 4,008,536 | A | 2/1977 | Adams | |
| 4,015,354 | A | 4/1977 | Brouthers | |
| 4,291,476 | A * | 9/1981 | Repa | F41G 11/003 42/124 |
| 4,628,611 | A | 12/1986 | Ruffino | |
| 5,208,407 | A | 5/1993 | Stover | |
| 5,275,084 | A | 1/1994 | Ruger | |

(Continued)

OTHER PUBLICATIONS

Yam, Hilton, M&P Core: Mounting the Opitc, First Look: S&W M&P Core; Nov. 30, 2012, Dec. 13, 2012; http://modernserviceweapons.com/?p=1289; http://modernserviceweapons.com/?p=1474; Modern Service Weapons.*

*Primary Examiner* — Joshua Freeman
(74) *Attorney, Agent, or Firm* — Knobbe Martens Olson & Bear LLP

(57) ABSTRACT

A firearm having a mounting surface which can include a recess formed on a slide of a pistol. The recess includes mounting posts and a plurality of sights include matching openings and fasteners so that mounting platforms of the plurality of sights can be mounted in the recess in a fixed orientation. The sights of the plurality of sights are movable relative to the platform but the platform is fixed with respect to the recess so that the platform is fixed with respect to the mounting surface. The recess is sized such that optical sights are aligned with original fixed sights.

19 Claims, 10 Drawing Sheets

(56) References Cited

U.S. PATENT DOCUMENTS 5,388,335 A 2/1995 Jung
5,467,552 A * 11/1995 Cupp ..... F41G 1/26 42/125
5,481,818 A 1/1996 Stover
6,327,806 B1 12/2001 Paige
7,032,341 B1 4/2006 Sconce et al.
7,634,866 B2 12/2009 Javorsky
7,730,655 B2 6/2010 SpuShr
8,061,255 B1 11/2011 Boberg
8,117,780 B2 2/2012 Matthews et al.
8,832,983 B1 * 9/2014 Wolf ..... F41A 3/12 42/16
8,893,422 B2 * 11/2014 Wolf ..... F41A 3/12 42/111
9,062,936 B2 * 6/2015 Zimmer ..... F41G 11/001
2005/0057808 A1 * 3/2005 Houde-Walter ..... F41C 27/00 359/566
2006/0064914 A1 3/2006 Greer
2006/0207157 A1 * 9/2006 Keng ..... F41G 1/32 42/132
2007/0199227 A1 8/2007 Ertl
2007/0234625 A1 * 10/2007 Kidd ..... F41G 1/28 42/111
2008/0092424 A1 4/2008 Keng
2008/0216379 A1 * 9/2008 Javorsky ..... F41G 1/345 42/115
2008/0244953 A1 10/2008 Kilic
2010/0083554 A1 * 4/2010 Elpedes ..... F41G 1/14 42/123
2010/0154273 A1 6/2010 Lippard
2012/0110886 A1 5/2012 Moore et al.
2013/0061511 A1 * 3/2013 Strayer ..... F41G 1/26 42/136
2013/0263492 A1 10/2013 Erdle
2013/0283659 A1 10/2013 Trapp et al.
2013/0283660 A1 10/2013 Matthews et al.
2014/0096431 A1 * 4/2014 Tang ..... F41G 1/30 42/132
2014/0109456 A1 * 4/2014 Jung ..... F41G 1/30 42/113
2014/0150325 A1 * 6/2014 Keng ..... F41G 11/003 42/118
2014/0165442 A1 6/2014 Nebeker et al.
2014/0230305 A1 * 8/2014 Zimmer ..... F41G 11/001 42/111
2015/0198421 A1 * 7/2015 Crispin ..... F41G 11/007 42/126

* cited by examiner

ACCESSORY MOUNTING SYSTEM FOR FIREARMS

BACKGROUND OF THE INVENTION

1. Field of the Invention

The present invention relates to firearms and, in particular, concerns a system for mounting accessories, such as optical or iron sights, onto a firearm.

2. Description of the Related Art

Firearms, such as pistols, typically include sights that allow the shooter to accurately fire the weapon. Often, shooters of firearms will use different types of sights in different types of circumstances. The different types of sights include telescopic sights, fixed or adjustable metal sights, optical sights that project a dot in a transparent screen indicating the point of aim of the firearm, and laser sights.

When aftermarket sights, such as optical sights, are mounted onto a firearm, the sight indicator may be positioned above the level of the original fixed or adjustable sight indicator. For example, with a standard pistol, there is a notch and blade sight that is aligned with the top of the slide, receiver or barrel. The original sight may be positioned at a height that is selected to coincide with the best point of aim for a person holding the firearm. When a new optical or laser sight is mounted on the receiver or slide, the point of aim of the aftermarket sight may be located at a level that is above the level of the fixed sight. This can introduce a level of inaccuracy to the aftermarket sight as the aftermarket sight isn't as precisely aligned with the firearm as the original sight.

Typically, when a new sight is fitted onto a firearm, the firearm and sight will have to be calibrated so that the point of impact of a bullet leaving the firearm coincides with the point of aim of the new sight. As there can be misalignment issues between newly installed sights and the firearm, the firearm often has to be resighted each time a new sight is used so that the firearm will shoot accurately. This process can be very time consuming and can limit the ability of the shooter to be able to switch between sights based upon the shooting environment.

To this end, there is a need for a system that permits aftermarket sights to be mounted so as to be more closely aligned with the original sights and so that sights to be interchanged on a firearm such that the firearm does not have to be resighted each time the sight is changed.

SUMMARY

The aforementioned needs are satisfied by the present invention which, in one non-limiting implementation, comprises an interchangeable sighting system for a firearm. The sighting system includes a mounting location formed on a portion of the firearm. The mounting location includes first mounting components. The system further includes a sight mounting platform that has second mounting components that are sized and spaced to engage with the first mounting components. The sight mounting platform includes a mounting location for the sight so that the sight can be securely mounted on the sight mounting platform. The sight may be adjustable with respect to the platform but the platform is fixed with respect to the mounting surface on the firearm.

In this way, the shooter mounts the sight on the sight mounting platform and then engages the first and second mounting components so as to secure the sight mounting platform in a fixed frame of reference to the mounting surface of the firearm. The shooter can then adjust the sight with respect to the sight mounting platform so as to align the sight so that the point of aim of the sight coincides with the point of impact of a projectile fired by the firearm. The shooter can then secure the sight in the desired orientation with respect to the sight mounting platform. Since the sight mounting platform is in a single fixed relationship to the mounting surface of the firearm when the first and second mounting components are engaged, the shooter does not have to resight the firearm each time the sight is positioned on the firearm.

In one implementation, the firearm is a pistol having a slide. The mounting location, in this specific location, comprises a groove or recess that extends along the length of the slide and has front and back surfaces. One or more protrusions are formed in the groove that includes openings. The sight mounting platform comprises a plate that is dimensioned so as to be positioned within the groove, preferably having front and back surfaces that abut the front and back surfaces of the groove. The sight mounting platform in this implementation further includes openings that receive the one or more protrusions and so that fasteners can be inserted through the sight mounting platform into the openings of the protrusions to secure the sight mounting platform in a fixed relationship with the mounting surface. A sight can then be fixedly mounted to the sight mounting platform and can be adjusted into a desired orientation with respect to the platform. As the platform is in a fixed orientation with respect to the firearm once the platform is secured in the groove, the orientation of the sight with respect to the firearm should not change as a result of the platform being taken off and then reinstalled on the firearm. Further, the recess and mountain components can be sized to receive the base of the known aftermarket sights that can be similarly adjusted.

Further, the aforementioned needs are satisfied by the present invention in another non-limiting implementation wherein a recessed surface of the firearm is formed on a top surface of the firearm. The recess is selected to have a depth that orients an aftermarket sight such that the sight indicator of the aftermarket sight is located at a vertical level that corresponds to the vertical level of the original sight on the firearm.

In one example, the recess comprises a recess that is sized to have a depth so that the sight indicator of a laser or optical sight is located at the level of fixed sights on the firearm. In one implementation, the recess comprises a recess formed on an upper surface of a slide of a pistol or on an upper surface of the receiver of a firearm. In one example, the recess has a longitudinal length that corresponds to the length of a mounting platform of the laser or optical sight. In one example, the recess includes mounting components that receive mounting components of the aftermarket sight so as to inhibit lateral motion of the optical sight when mounted within the recess.

These and other objects and advantages of the present invention will become more apparent from the following description taken in conjunction with the accompanying drawings.

DETAILED DESCRIPTION

Reference will now be made to the drawings wherein like numerals refer to like parts throughout.

Figure 1A:
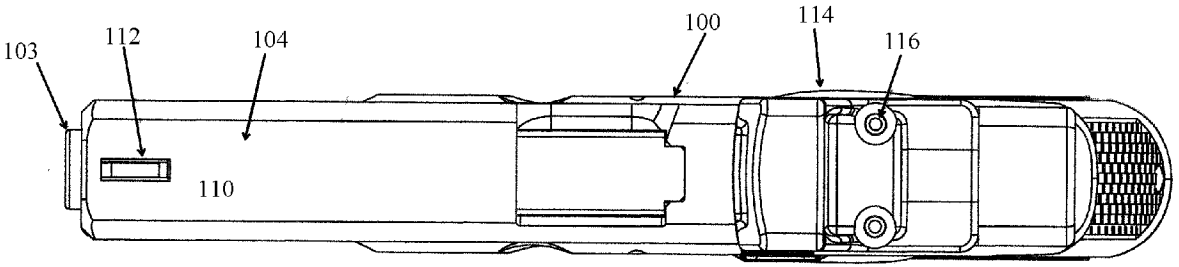
FIGS. 1A and 1B are top and side views of a firearm with a first sight affixed thereto.
Figure 1B:
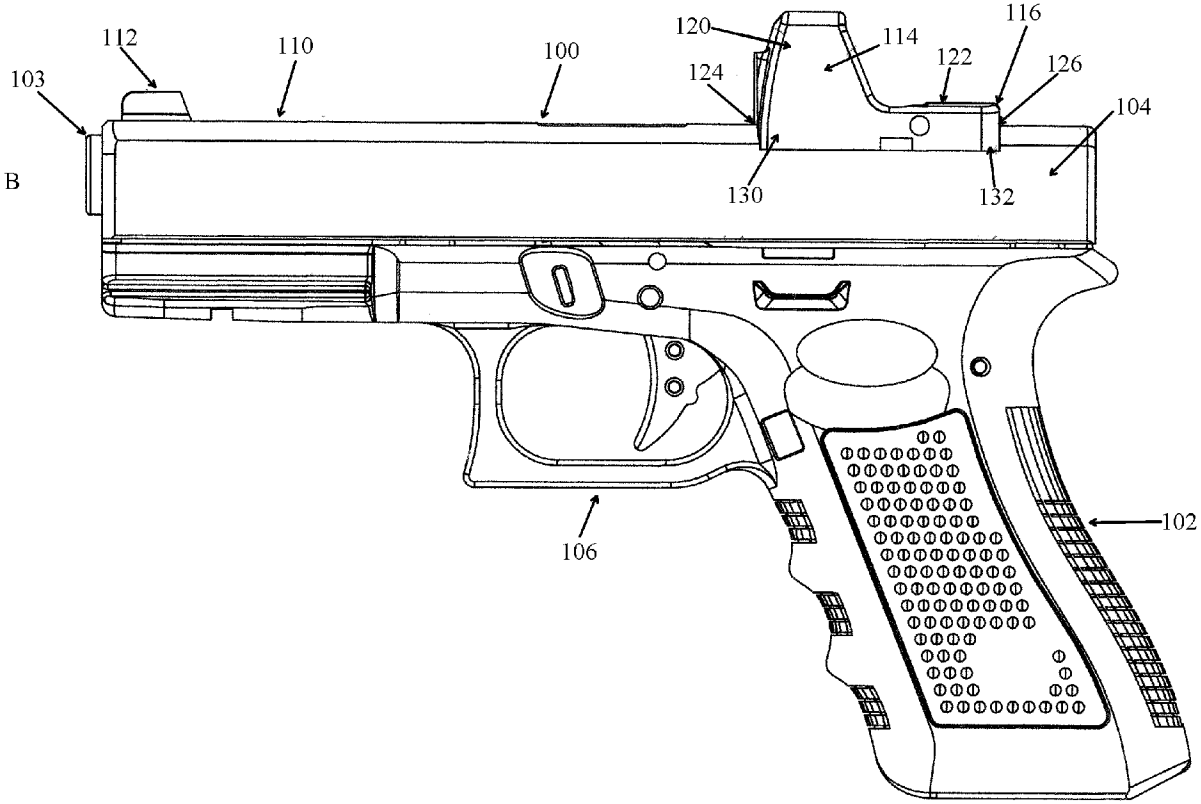
Figure 2A:
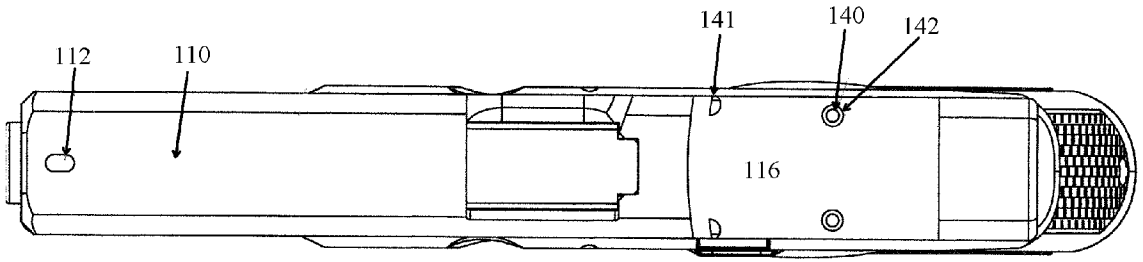
FIGS. 2A and 2B are top and side views of the firearm of FIGS. 1A and 1B with the first sight removed to illustrate the mounting location and groove of the first sight.
Figure 2B:
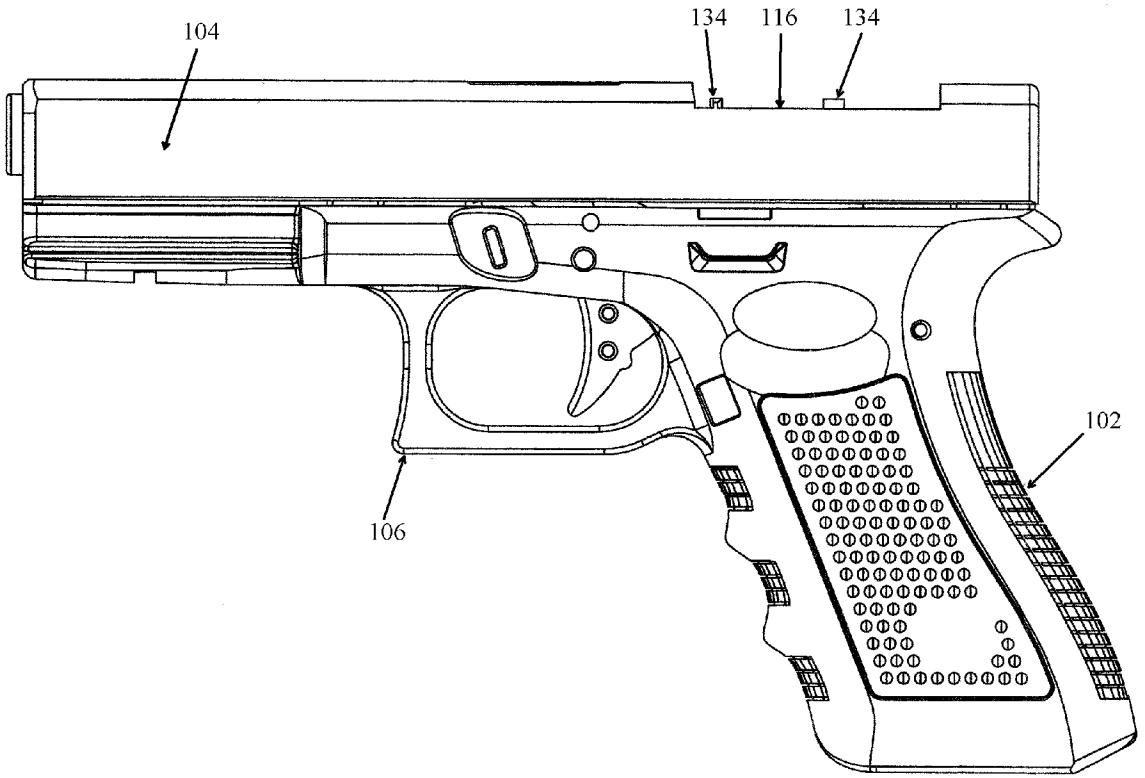
Figure 3A:
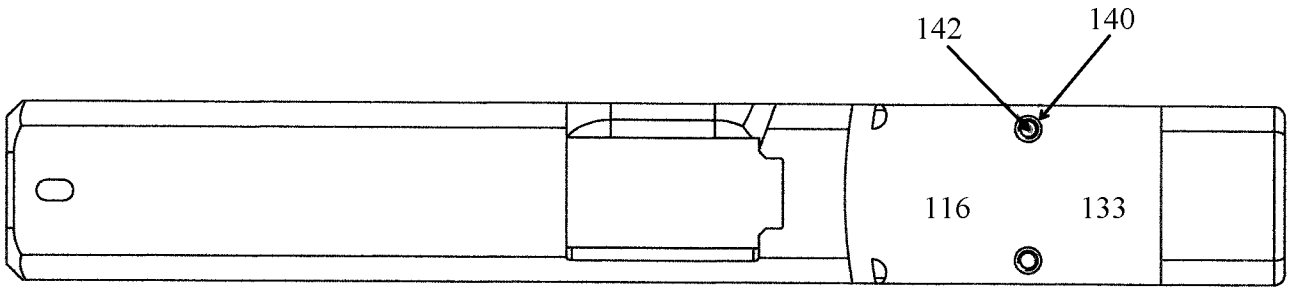
FIGS. 3A and 3B are top and side views of a slide of the firearm of FIGS. 1A, 1B, 2A and 2B that illustrate the mounting location and groove in greater detail.
Figure 3B:
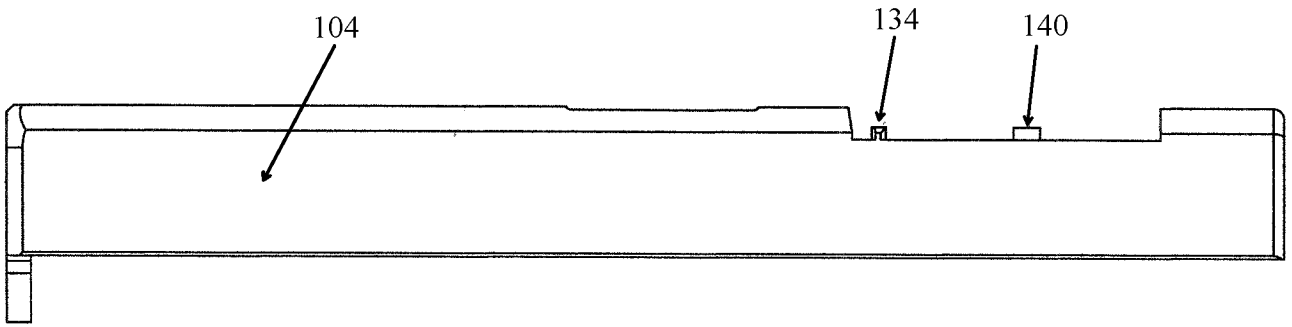

FIGS. 1A and 1B illustrate an exemplary firearm 100 that includes a frame 102 and a slide 104. The frame includes a trigger assembly 106 and the slide 104 accommodates a receiver and a barrel 103. It will be appreciated that the following description describes embodiments of the present invention in connection with mounting locations located on a slide 104, however, persons of ordinary skill in the art will appreciate that any sight mounting location, such as on the top of a receiver, can be used to mount the mounting system of the present invention without departing from either the spirit or the scope of the present invention.

The slide 104 includes an upper surface 110 that has a front fixed sight 112 formed thereon. It will be appreciated that the front fixed sight 110 does not have to be mounted on the slide 110 but can, in some firearms, be mounted on the barrel when the barrel is exposed. As is also shown, firearm 100 includes a first sight 114 that can be an optical sight such as a Trujicon RMR or a Leopold Data Point, Comte STS or other sights that project a light image on a display screen at the point of aim of the firearm in a known manner or a laser sight that also projects a light image onto the point of aim of the firearm 100 in a known manner.

As is shown in FIGS. 1A and 1B, the first sight 114 is positioned in a recess 116 that is selected to have a depth from the upper surface 110 of the slide 104 so that the center axis of the light image of the sight 114 is more closely aligned to correspond with the vertical location of the front fixed sight. In one implementation, the depth of the recess 116 is selected so that the vertical orientation of the light image of the first sight 114 is at the same height as the vertical orientation of the fixed front sight 112. Exemplary depths of the recess 116 can be in the range of 0.090" to 0.200". In other implementations, the light image is more closely aligned with the bore or the firearm. In this way, the shooter holds the firearm 100 in a manner that more closely corresponds to the manner in which the user would hold the firearm when shooting the firearm with the original fixed sights. Firearms are typically designed such that the grips, receivers, trigger assembly and sights are positioned with respect to each other to improve the shooter performance. By recessing the first sight 114 into the recess 116, the shooting experience for the shooter more closely approximates the original design of the firearm.

As shown in FIGS. 1A, 1B, 2A, 2B and 3A, 3B the first sight 114 includes a display 120 that extends vertically upward from a base member 122. The recess 116 is preferably contoured so as to have front and rear edges 124, 126 respectively. The front and rear edges 124, 126 are positioned so that the front and rear edges 130, 132 of the base member of the first sight 114 are flushly positioned against the front and rear edges 124, 126 of the recess 114. In this way, the base member 122 of the first sight 114 is inhibited from moving along the longitudinal axis of the slide 104 or barrel. It will be appreciated that the location of the front and rear edges 124, 126 of the recess 116 will vary depending upon the configuration of the base 122 of the first sight 114 and that different models of first sights will requires different sizes or even shapes of the recess 114 and the first and second edges 124, 126.

As is also shown in FIGS. 1A, 1B, 2A and 2B and 3A and 3B, the recess 116 includes mounting components 134 and the first sight 114 includes mounting components 136 that couple with the mounting components 134 formed on the inner surface 133 of the recess 116. In one implementation, the mounting components 134 of the recess 116 comprise posts 140 having threaded openings 142 and projections 134. In this implementation, the mounting components 136 of the first sight 114 comprise openings and screws 144 that are positioned to engage with the posts 140 so that the post extend into the openings of the base member 122 of the first sight 114 and recesses 143 (FIG. 5C) that receive the projections 141.

In this implementation, there are two posts 140 that are sized and located on the surface 133 of the recess 116 to correspond to the mounting openings of the first sight 114, it will be appreciated, however, that the location and configuration of the mounting components 134 will vary depending upon the first sight 114 being mounted on the firearm 100 and that the location and configuration of the mounting component 134 can also vary without departing from the spirit or scope of the present invention. It will further be appreciated, that two posts 140 are shown that are laterally spaced apart. The use of multiple posts inhibits lateral or rotational movement of the first sight 114 particularly when the two laterally aligned. However, it will be appreciated that a single post, in combination with the edges 124, 126, can also inhibit lateral and rotational motion of the first sight 114 without departing from the spirit or scope of the present invention.

FIGS. 4A, 4B, 5A-5C and 6A, 6B illustrate a second sight 150 with a mounting platform 152 that can also be used with the recess 116 of the firearm 100. The mounting platform 152 is sized so as to fit within the recess 116 such that front and rear surfaces 160, 162 abut the front and rear edges 124, 126 of the recess 116 in the same manner as described above with respect to the base 122 of the first sight. Similarly, the mounting platform 152 also includes mounting components 154, such as holes and screws that receive the posts 140 in the bottom surface 133 of the recess and are secured thereto by screws in the same manner as described above in connection with the base 122 of the first sight 114.

Figure 4A:
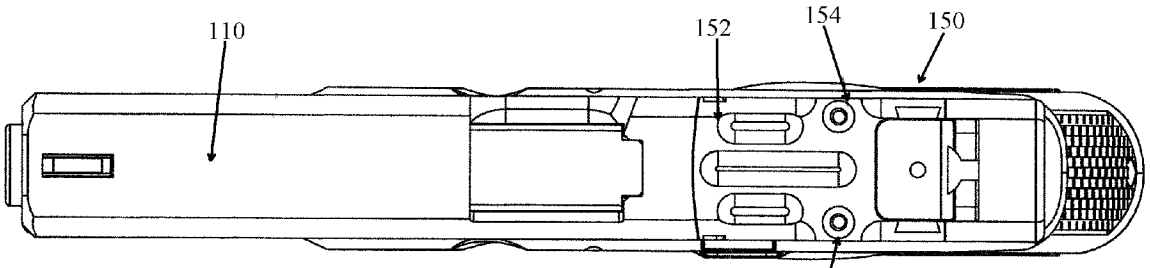
FIGS. 4A and 4B are top and side views of the firearm of FIGS. 1A, 1B, 2A, 2B that illustrate a second sight mounted thereon.
Figure 4B:
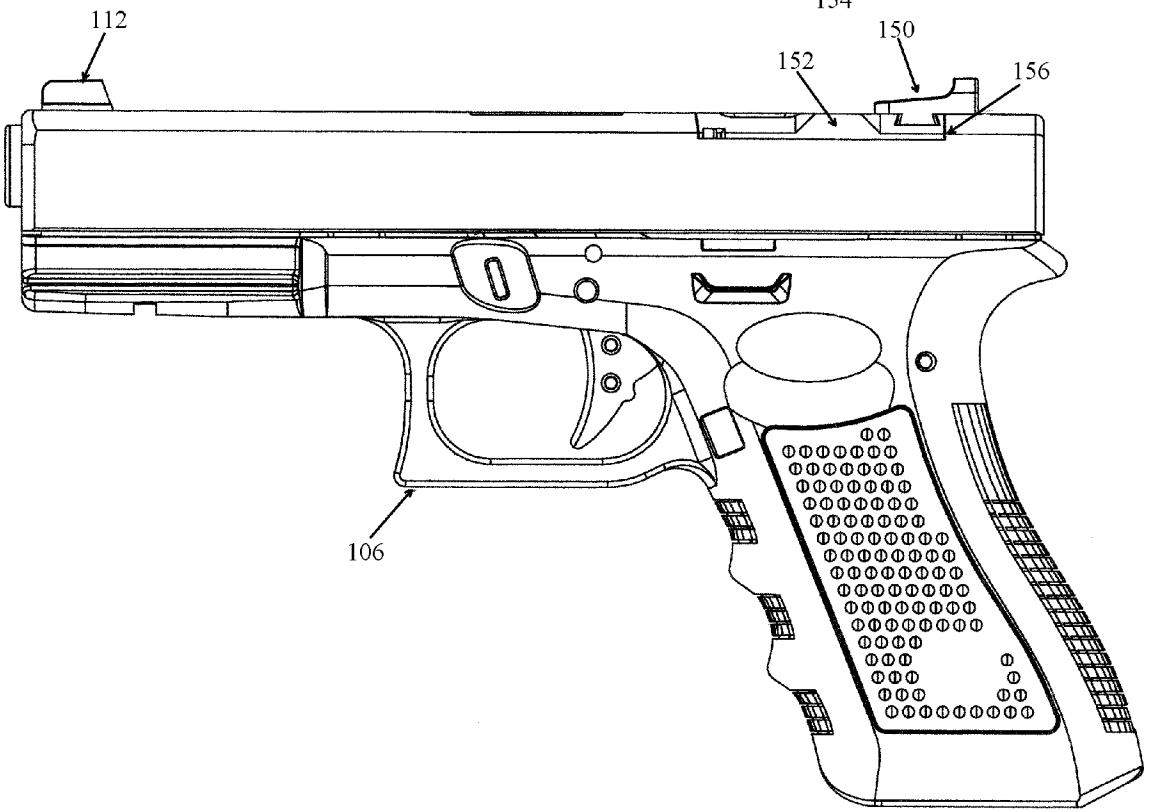

The mounting platform 152 is a generally planar platform that has a thickness substantially equal to the depth of the recess so that the upper surface of the platform 152 is substantially flush with the upper surface 110 of the slide 104 as is shown in FIG. 4B. The platform 152 includes a laterally extending notch 156 that accommodates the second sight 150 via a friction fit.

Figure 5A:
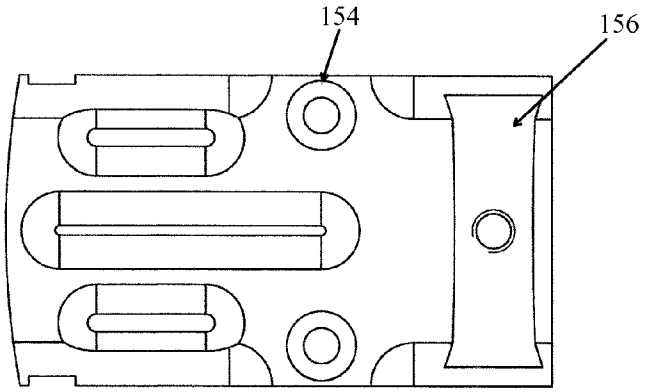
FIGS. 5A-5C are top, side and bottom views of a mounting platform that accommodates the second sight.
Figure 5B:
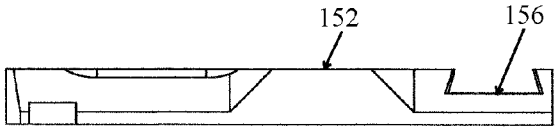
Figure 5C:
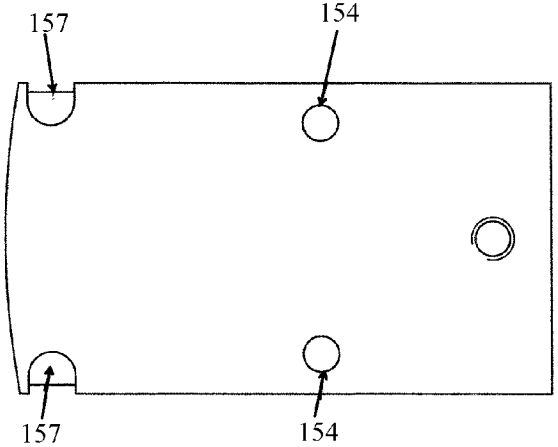

FIG. 5C illustrates the bottom side of the mounting platform 152. As shown, there are openings 154 that are sized to receive the posts 140 in the manner described above. Further, there are recesses 157 that extend inward from the outer lateral edges of the mounting platform 152 that receive the projections 141 formed in the recess 116. The posts 140 and projections 141 are positioned so as to be longitudinally spaced and the projections 141 are located outwards of the posts 140. These components, in combination with the edges of the recess 116 further retain the mounting platform 152 in the desired orientation in the recess 116 and inhibit movement of the mounting platform 152 and accompanying sight with respect to the mounting surface of the firearm. It will further be appreciated that the first sight 114, will also preferably have the same configuration of openings 154 and recesses 157 that receive the projections 141 to retain the first sight 114 in the same fixed orientation with respect to the bore of the firearm 100.

Figure 6A:
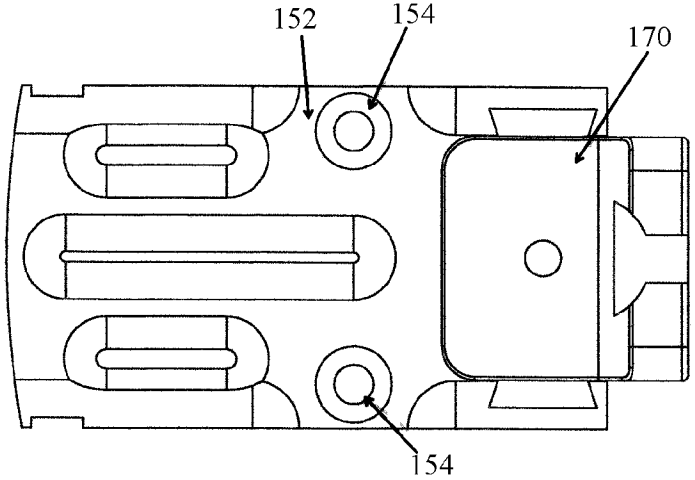
FIGS. 6A and 6B are top and side views of a firearm having a slide with a mounting location and groove where a second sight is mounted in a notch formed in the slide behind the mounting location and groove.
Figure 6B:
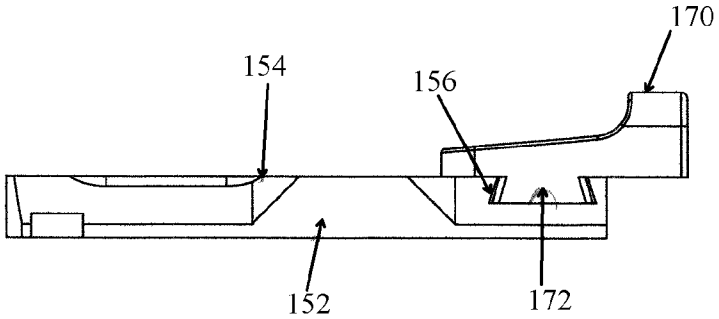

As shown in FIGS. 6A, 6B, the second sight 150 can, in this embodiment, comprise a notched plate 170 of a standard notch and blade sight. The notched plate 170 of the second sight 150 is preferably adjustable laterally so that a shooter can align the second sight 150 along a range of different lateral positions to align the point of aim of the firearm with the desired point of impact in a well-known manner. The notch 156 can be flanged outward on the bottom side and the notched plate 170 may also include a matching mounting member 172 that engages with the notch 156 to provide the friction fit.

Figure 7A:
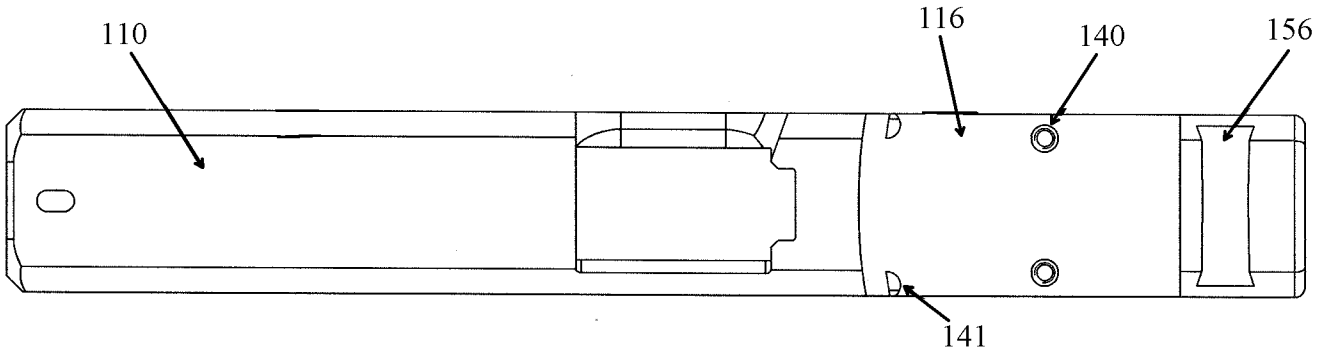
FIGS. 7A and 7B are top and side views of another embodiment of a slide of a firearm that has a mounting recess for a plate or base of an aftermarket sight and a notch for receiving an iron sight.
Figure 7B:
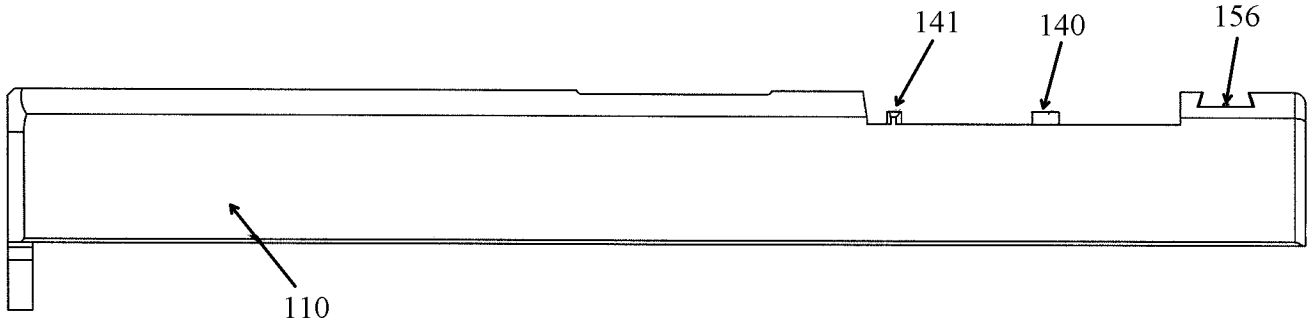

FIGS. 7A and 7B illustrate an embodiment of a slide 110 that includes a recess 116 that can receive the base of a first sight 114 or the mounting platform 152 for the second sight 150. In this embodiment, however, the second sight may also be mounted in a notch 156 that is formed on the slide 110 itself rather than on the mounting platform 152. The mounting platform 152 may be configured to receive a first sight or a different type of sight and the iron sight may be mounted on the notch 156 on the slide rather than on the mounting platform 152. It will be appreciated that various modifications and changes to the application may be made without departing from the scope of the present invention.

Figure 8A:
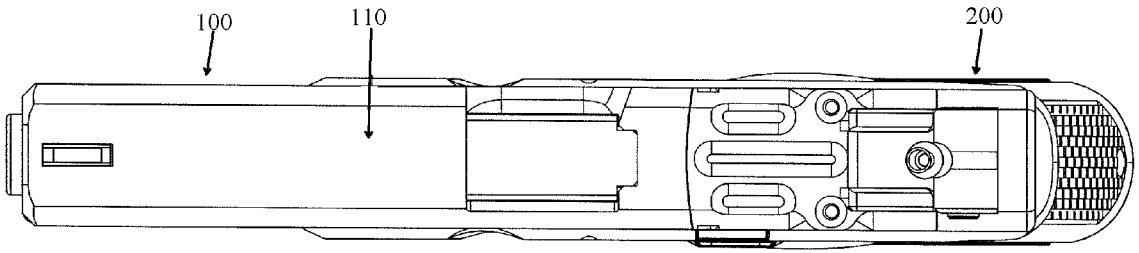
FIGS. 8A and 8B are top and side views of another embodiment of a slide of a firearm that has an adjustable rear sight.
Figure 8B:
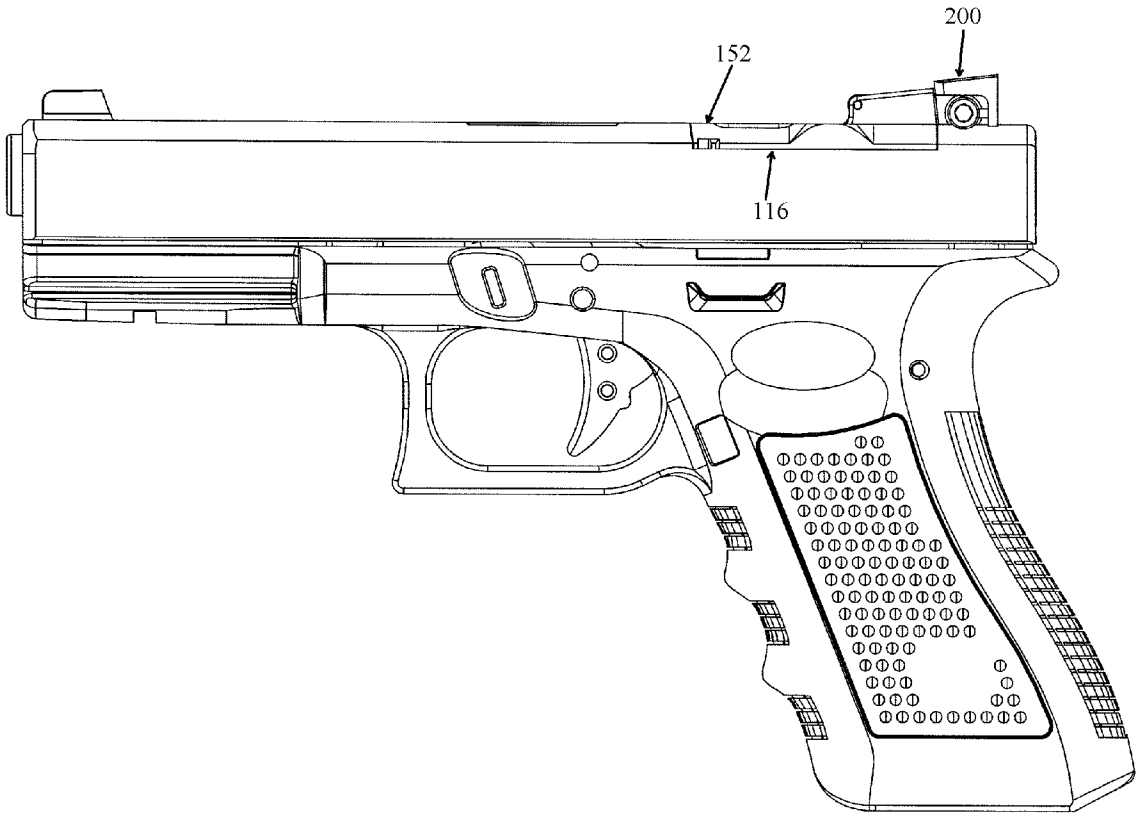
Figure 9A:
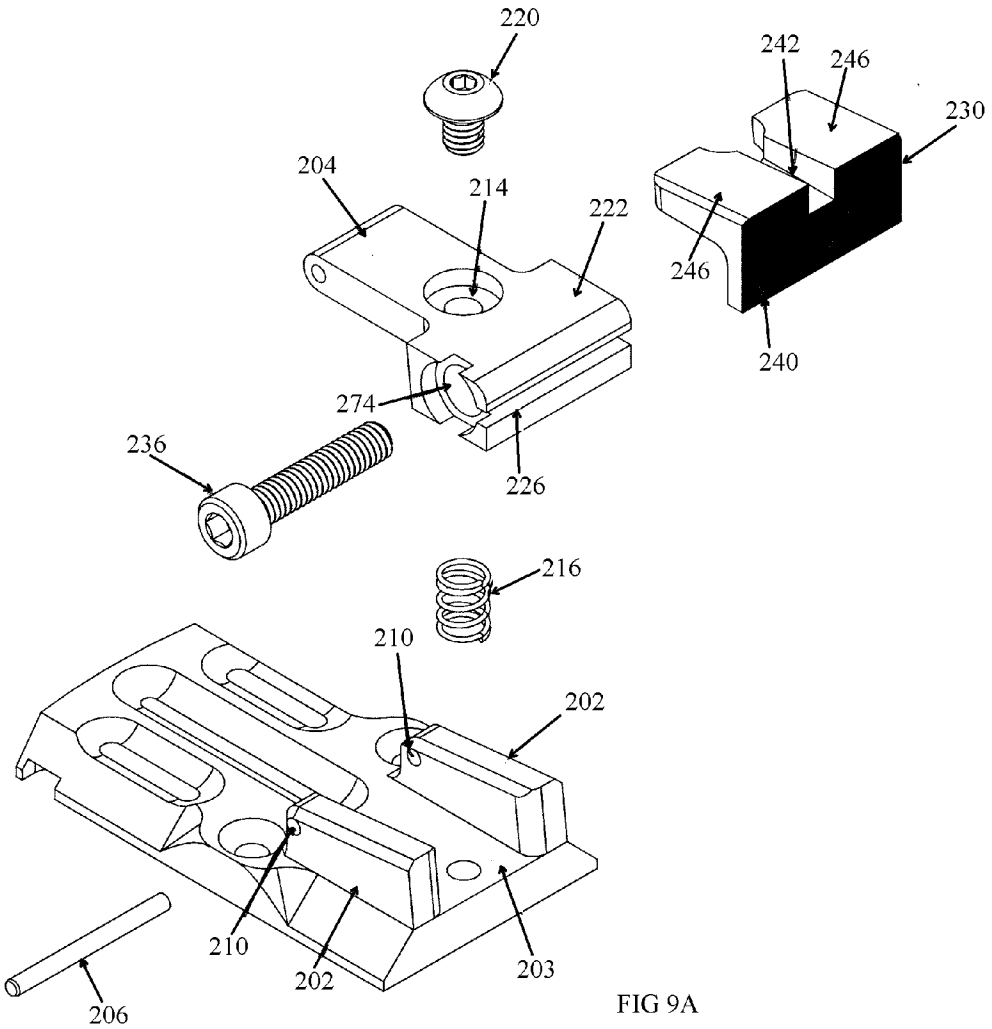
FIGS. 9A-9D are exploded, top, side and bottom views of an adjustable rear sight that can be used with the mounting system of FIGS. 1-7.
Figure 9B:
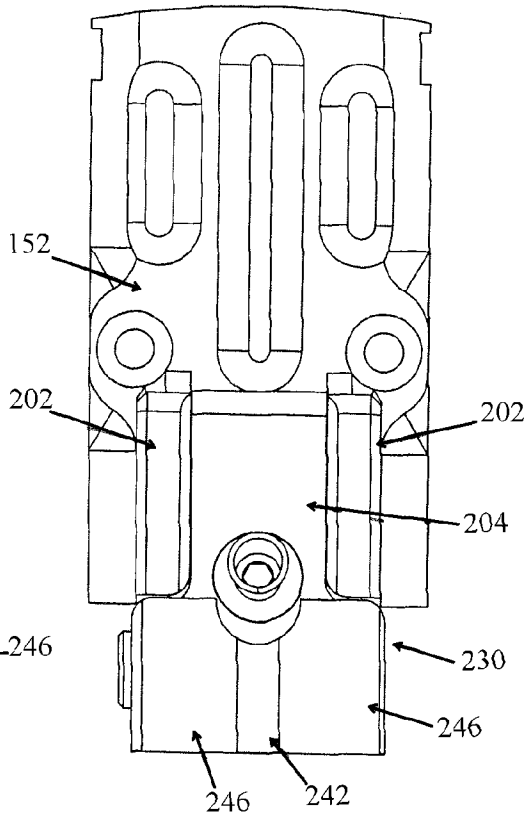
Figure 9C:
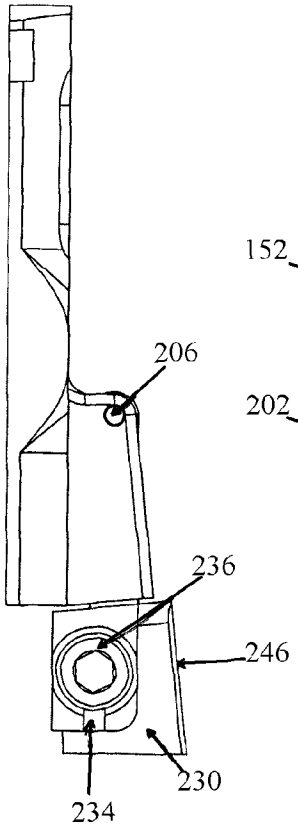
Figure 9D:
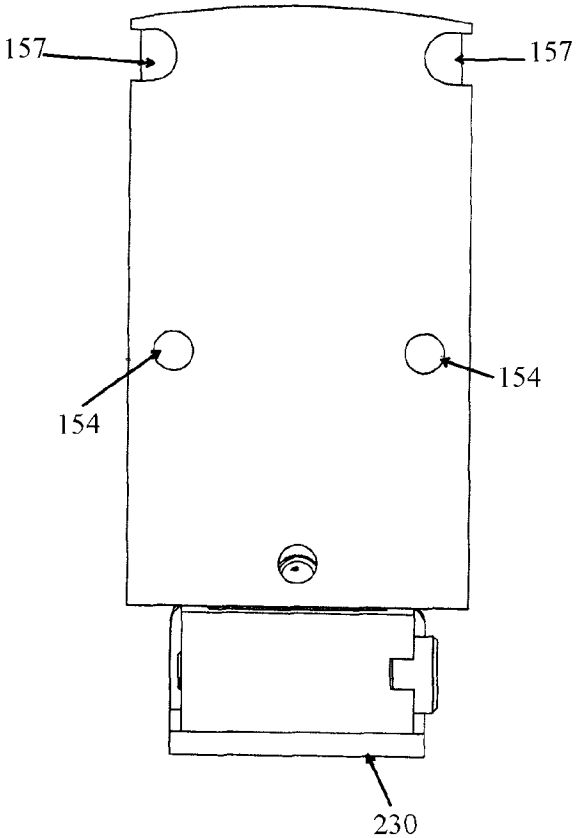

FIGS. 8A and 8B are top and side views of a firearm 100 that is equipped with an adjustable rear sight assembly 200 that is mounted on a mounting platform or adaptor plate 152 in the previously described manner. The adjustable rear sight assembly 200 can be one of a number of different sight configurations used with the mounting platform 152 which can also be referred to as an adaptor plate. The sight 200 can be adjusted with respect to the plate 152 and then the plate 152 can be removed and then reinstalled without requiring that the sight be readjusted as the plate 152 mounts to the recess 116 in the same manner and the sight 200 is not moving with respect to the plate 156. The rear sight 200 is preferably adjustable both in a vertical and horizontal orientation in the manner that will be described herein below.

Referring to FIGS. 9A-9D, the components and parts of the rear sight assembly 200 is described in greater detail. As shown, the plate 152 is fitted with two parallel mounting blocks 202 that extend upward from the surface 203 of the plate 152. The mounting blocks 202 are located adjacent the rear of the plate 152 such that a portion of the rear sight 200 is positioned over the horizontal surface 110 of the firearm 100 in the manner shown in FIGS. 8A and 8B. The assembly also includes a swing body 204 that is pivotally mounted to the mounting blocks 202 via a pin 206 that is positioned through two openings 210 formed in the mounting blocks 202.

A main body 212 of the swing body 204 has an opening 214 that engages with a spring 216 that is positioned between the swing body 204 and the surface 203 of the plate 152. A fastener 220 extends through the opening 214 and engages with the spring 216 so that the vertical position of the swing body 204 can be adjusted by adjustment of the fastener 220 as the swing body pivots about the pin 206. In one embodiment, the fastener 220 engages with an opening formed in the surface 203 of the plate 152 (See FIG. 9D).

The swing body 204 includes a horizontal mounting component which comprises a horizontally extending shaft 224 that has a slit 226 that is exposed to the rear of the sight assembly 200. A sight plate member 230 with a protrusion 234 is mounted in the slit 226 in the manner shown in FIG. 9C. A fastener 236 extends into the shaft 224 and engages with the protrusion 234 to move the sight plate member 230 horizontally with respect to the plate 152 and the bore of the firearm 200. The sight plate member 230 includes a vertically extending face 240 with a notch 242. The front side of the vertically extending face 240 has the protrusion 234 and is positioned adjacent the rear of the swing body 204. The sight member 230 also includes two horizontal surfaces that are positioned over the top of the mounting component 222 of the swing body 204 in the manner shown in FIG. 9C.

The mounting system described hereinabove advantageously allows a plurality of sights to be used on the firearm 100 interchangeably with reduced need to resight the firearm for each sight. More specifically, the recess and mounting components are designed such that the first sight and the second sight are in a fixed relationship with the firearm when the first sight and second sight are mounted in the recess 116. The recess 116 inhibits both longitudinal and lateral movement of both sights as a result of the base 122 and the platform 152 being fixed within the recess 116. Consequently, once a sight is aligned with the firearm, the first sight 114 and second sight 150 can be removed via removing the base 122 or the platform 152. When the base 122 or platform 152 is replaced into the recess 116, the orientation of the first and second sight 114, 150 with respect to the firearm 100 is maintained. This permits multiple sights to be used with the firearm 100 without requiring the firearm 100 to be re-sighted each time a sight is interchanged. While the foregoing discussion has described two sights, it will be appreciated that any number of sights can be used on the firearm with the mounting location described herein without departing from the spirit or scope of the present invention.

Consequently, although the foregoing has shown, illustrated and described embodiments of the present invention and uses thereof, it will be appreciated that various changes and modifications to the features described herein as well as the uses thereof may be made by those skilled in the art without departing from the spirit or scope of the present invention. Hence, the present invention should not be limited to the foregoing discussion but should be defined by the appended claims.

What is claimed is:

1. A firearm comprising:

a frame;

a barrel and receiver assembly;

a trigger assembly;

wherein the firearm includes a horizontal surface that provides a sighting surface, wherein the horizontal surface includes a mounting location that is contoured to receive a plurality of mounting platforms with attached sights that are adjustable to the mounting platforms wherein the mounting location is further contoured such that once a sight is sighted on the firearm with respect to the mounting location, the sight is removable and reinstallable onto the mounting location with the sight remaining sighted with respect to the firearm wherein the mounting location comprises a recess that includes mounting components comprises posts that extend outward from the recess and are coupled thereto and have threaded openings formed in the posts and projections that are mounted to the recess outward of the posts towards the sides of the recess.

2. The firearm of claim 1, wherein sights on the plurality of mounting platforms includes optical sights and blade and flange sights.

3. The firearm of claim 1, wherein one of the plurality of mounting platforms includes an optical sight has a platform and a display which displays an light image on a display that is adjustable with respect to the platform.

4. The firearm of claim 3, wherein one of the plurality of mounting platforms includes a blade and flange sight includes a platform and a notched flange that is laterally adjustable with respect to the platform.

5. The firearm of claim 1, wherein the mounting location comprises a recess having front and back edges positioned longitudinally along the length of the horizontal surface and wherein the front and back edges of the mounting platforms of the plurality of sights abuts the front and back edges of the recess.

6. The firearm of claim 5, wherein the recess includes mounting components and the plurality of mounting platform includes matching mounting components that engage with the mounting components of the plurality of mounting platforms to inhibit lateral and rotational movement of the mounting platform of the plurality of sights.

7. The firearm of claim 6, wherein the mounting components of the recess comprises posts and the mounting components of the plurality of sights include openings that receive the posts and fasteners that engage with threaded openings in the posts.

8. The firearm of claim 7, wherein the posts are are laterally spaced apart the recess.

9. The firearm of claim 8, further comprising projections formed in the recess that engage with recesses formed in the mounting platform.

10. The firearm of claim 9, wherein the recesses formed in the mounting platform are longitudinally offset from the posts and extend inwardly from the lateral edges of the mounting platform.

11. The firearm of claim 5, wherein the firearm includes a original fixed sight and the recess has a depth selected so that a vertical position of an optical sight mounted in the recess corresponds to the vertical location of an original fixed sight.

12. The firearm of claim 11, wherein the platform for a fixed sight and the recess are dimensioned so that the platform is flush with the horizontal surface.

13. The firearm of claim 1, wherein the mounting location is formed on a slide of the firearm.

14. The firearm of claim 1, wherein one of the mounting platforms includes an iron sight with an adjustable back sight.

15. The firearm of claim 14, wherein the adjustable back sight comprises two mounting blocks mounted on the mounting platform and a pivoting swing arm that pivots with respect to the mounting blocks so that the vertical position of the sight can be adjusted via pivoting the swing arm member.

16. The firearm of claim 15, further comprising a spring and fastener wherein the spring is interposed between the swing arm member and a surface of the platform so as to bias the swing arm member outward and adjustment of the fastener adjusts the vertical position of the swing arm member.

17. The firearm of claim 15, further comprising a sight member that is mounted to an end of the swing arm member so as to be movable in a lateral fashion.

18. The firearm of claim 17, further comprising a shaft formed in the swing arm member that has a notch and wherein the sight member includes a protrusion that extends through the notch into the shaft and wherein the back sight further comprises a fastener that extends through the shaft and engages with the notch to adjust the sight member laterally.

19. A firearm comprising:

a frame;

a barrel and receiver assembly;

a trigger assembly;

wherein the firearm includes a horizontal surface that provides a sighting surface, wherein the horizontal surface includes a mounting recess that is contoured to receive a plurality of mounting platforms with attached sights that are adjustable to the mounting platforms wherein the mounting recess are further contoured such that once a sight is sighted on the firearm with respect to the mounting location, the sight is removable and reinstallable onto the mounting location with the sight remaining sighted with respect to the firearm and wherein the depth of the recess is selected so as to orient an optical sight's axis to coincide with original iron sights on the firearm wherein the mounting location comprises a recess that includes mounting components comprises posts that extend outward from the recess and are coupled thereto and have threaded openings formed in the posts and projections that are mounted to the recess outward of the posts towards the sides of the recess.

* * * * *